US006056154A

United States Patent [19]

Fowler

[11] Patent Number: 6,056,154

[45] Date of Patent: May 2, 2000

[54] FLUID REFILLING AND DISPENSING SYSTEM

[76] Inventor: Ruth Christine Fowler, 210 Yerba Buena Ave., Los Altos, Calif. 94022

[21] Appl. No.: 09/159,354

[22] Filed: Sep. 23, 1998

[51] Int. Cl.[7] ..... B67B 7/00

[52] U.S. Cl. ..... 222/1; 222/63; 222/67; 222/146.6

[58] Field of Search ..... 222/1, 63, 67, 222/129, 131, 154, 146.1, 146.6

[56] References Cited

U.S. PATENT DOCUMENTS

| | | | |
|---|---|---|---|
| 2,744,660 | 5/1956 | Jacobs | 22/154 |
| 3,269,143 | 8/1966 | Gasparovich | 62/389 |
| 3,572,553 | 3/1971 | Ogden | 222/678 |
| 4,815,941 | 3/1989 | Fayo | 417/44 |
| 4,830,223 | 5/1989 | Priest | 222/146 |
| 4,923,091 | 5/1990 | Sutera | 222/67 |
| 4,958,747 | 9/1990 | Sheets | 222/67 |
| 4,987,746 | 1/1991 | Roberts | 62/137 |
| 5,003,790 | 4/1991 | Goupil | 62/389 |
| 5,127,618 | 7/1992 | Page et al. | 248/313 |
| 5,495,725 | 3/1996 | Middlemiss | 62/389 |
| 5,540,355 | 7/1996 | Hancock et al. | 222/56 |

*Primary Examiner*—Gregory L. Huson
*Attorney, Agent, or Firm*—Fish & Richardson P.C.

[57] ABSTRACT

A fluid dispensing system is provided for receiving fluid from a container positioned near the ground and for transporting the water up to a reservoir suitable for dispensing. The system has a cabinet having first and second chambers. A slidable support base is mounted in the first chamber to support a container for storing fluid. A reservoir is mounted in the second chamber, the reservoir further having a spigot to dispense the fluid upon request. A sensor detects a predetermined fluid level in the reservoir, and a temperature adjuster maintains the fluid at a predetermined temperature range. The system also has a pump for transporting fluid from the container to the reservoir and a circuit connected to the pump and to the sensor for activating the pump when fluid in the reservoir falls below the predetermined fluid level.

20 Claims, 4 Drawing Sheets

FLUID REFILLING AND DISPENSING SYSTEM

BACKGROUND

The invention relates to fluid refilling and dispensing systems.

In many households or offices, fluid dispensing systems such as water coolers have become ubiquitous. Their popularity may be attributed in part to consumers' realization that various chemical products added by utilities to the drinking water supply to prevent bacteria growth may actually have adverse effects on the consumer's well-being. Additionally, certain types of additives such as those containing chlorine may provide objectionable taste and color to the water. Hence, health-conscious consumers have enthusiastically adopted water coolers.

Drinking water is usually available from a number of suppliers in bottles which are designed to be received by dispensers housed in a cabinet. The cabinet typically provides a support fixture for receiving the bottle in an inverted position so that water may be fed by gravity to an internal reservoir. The drinking water is then dispensed through a manually operated tap or spigot which is connected to the reservoir. When water has been completely dispensed from the bottle, the empty bottle is removed and replaced with a full bottle of water, which is relatively heavy. The bottle replacement process is typically accomplished by lifting the full bottle, inverting the full bottle, positioning the inverted full bottle on top of the support fixture, and carefully guiding the inverted full bottle so that its mouth is aligned with a receptacle connected to the internal reservoir.

Although convenient and healthy to use, one problem with existing water coolers is that they require a significant amount of physical exertion to lift, flip and properly guide the mouth of the full bottle into the reservoir receptacle. Not everyone can physically perform this task. The bottle replacement process can be particularly difficult for children or persons with limited strength. Moreover, the process of rapidly inverting the water bottle and positioning the neck of the bottle into the reservoir receptacle may expose the reservoir to contamination and expose the user to water spillage.

SUMMARY

A fluid dispensing system is provided for receiving fluid from a bottle positioned near the earth and for transporting the fluid up to a reservoir suitable for a gravity-based dispensing. The system stores the fluid in the bottle at ambient temperature and dispenses the fluid which is chilled or warmed to a predetermined temperature, including ambient temperature, on request. The system has a cabinet with first and second chambers. The first chamber has a slidable bottle support base which supports the bottle and allows the bottle to be easily maneuvered to and from the cabinet. The second chamber contains one or more reservoirs with a built-in sensor for detecting a predetermined fluid level for initiating the liquid refill process. The refill system for maintaining the reservoir fluid at the predetermined temperature range includes a pump which transports the fluid from the bottle to the reservoir and a control circuit connected to the pump and to the sensor which activates the pump when the fluid in the reservoir falls below the predetermined fluid level. The reservoir has a spigot to dispense fluid upon request.

Implementations of the invention include the following. The bottle's proximity to the earth minimizes the work required to place the bottle on top of the slidable bottle support base. The control circuit may contain a voltage step-down converter for generating a predetermined voltage and a switch connected to the step-down converter, the pump, and the sensor. The switch supplies the predetermined voltage from the step-down converter to the pump when the sensor detects that the fluid in the reservoir is below the predetermined fluid level. The fluid level sensor may be a float switch wich may be mounted horizontally or vertically. Moreover, a voltage regulator or a capacitor may be connected to the step-down converter to improve the quality of power supplied to the system. Additionally, a translucent door may be provided for the first chamber to allow users to view the amount of fluid remaining in the bottle. Further, a cap with a tube passing through is provided to seal and protect the bottle in addition to transporting the fluid from the bottle to the pump.

Implementations of the system may additionally include the following. The system may provide a second reservoir mounted in the second chamber with a second sensor for detecting a second predetermined fluid level, said second reservoir further having a second spigot to dispense the fluid upon request. The system may also have a second temperature adjustment system connected to the second reservoir to maintain the fluid at the second predetermined temperature range.

Implementations of the system may also include the following. The slidable bottle support base has one or more wheels mounted thereon to allow the bottle to be easily moved in or out of the cabinet. The ambient temperature of the fluid in the bottle may be room temperature, and the predetermined temperature may be lower, higher, or the same as the ambient temperature.

When fluid is to be refilled, the user removes the empty bottle. A full bottle is moved onto the slidable bottle support base and both are rolled into the cabinet. Since the slidable bottle support base is near the earth, the user exerts a minimal force for the transfer. The cap with the tube passing through is placed onto the bottle's opening to connect the pump to the bottle. During operation, the control circuit activates the pump when the fluid level falls below the predetermined fluid level. Moreover, the circuit detects when the bottle is empty and disables the pump to prevent damaging the pump.

Advantages of the invention include the following. The awkward lifting and inverting maneuver process in refilling conventional water coolers is avoided. Possible reservoir contamination and fluid spillage is avoided. Further, the fluid refill process is automatically initiated so that a fresh supply of temperature controlled fluid is available upon request. The system may provide a plurality of fluid sources, each maintained with a different temperature control. Also, the system is constructed using standardized off-the-shelf components to minimize construction and maintenance cost.

These and other objects, advantages and features of the invention will become apparent when the detailed description is studied in conjunction with the drawings.

DESCRIPTION

Figure 1A:
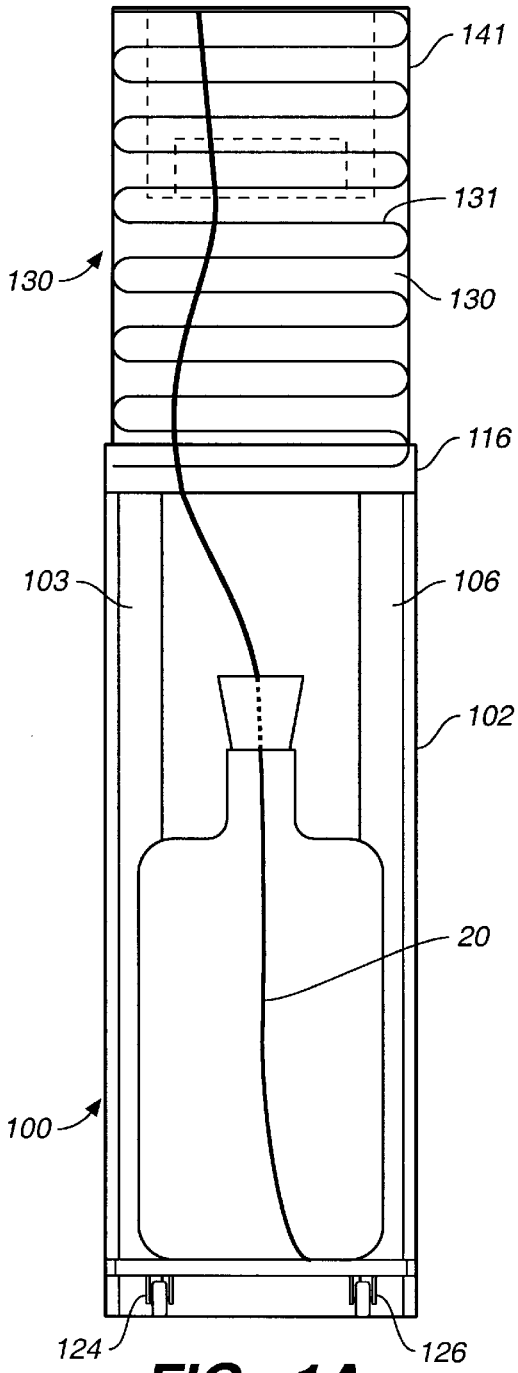
FIGS. 1A and 1B are a side view and a back view, respectively, of a fluid refilling and dispensing system in accordance with the invention.
Figure 1B:
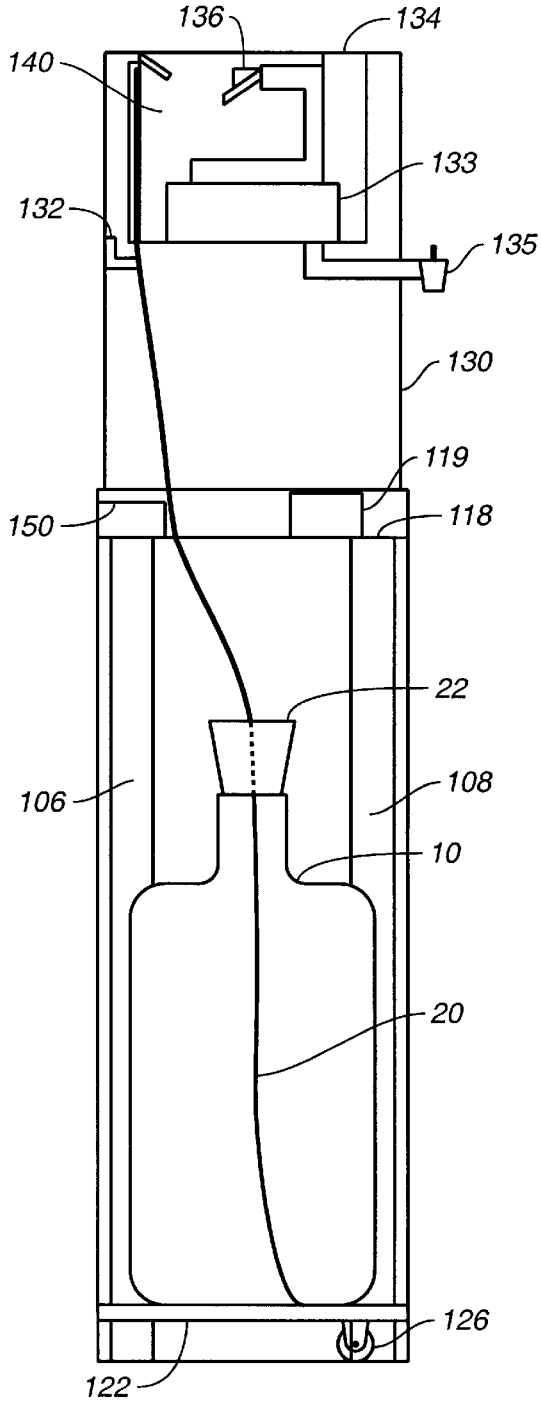

Referring now to FIGS. 1A and 1B, a system for refilling and dispensing a fluid, such as water, and which is designed to minimize exertions on a user in exchanging bottles containing the fluid, is shown. The side-walls have been removed to show more clearly the components of the system. A cabinet 100 houses a bottle 10 in a first chamber 102 and associated fluid transporting, cooling and dispensing components in a second chamber 130.

In the first chamber 102, the bottle 10 rests on top of a slidable bottle support base 122. The slidable bottle support base 122 is joined to the cabinet 100 at one end proximally near the ground. The slidable bottle support base 122 is supported by a plurality of rails 114 and 112, which is shown in more detail in FIG. 2. The slidable bottle support base 122 is also mounted on top of two castor wheels 124 and 126 to improve mobility. Wheels 124 and 126 enable the bottle, which may be full of fluid and may be quite heavy, to be easily maneuvered by the user to and from the cabinet 100 for loading or unloading operations.

The fluid in the bottle 10 is stored in the first chamber 102 at an ambient temperature, which may be room temperature. The fluid may be dispensed through an opening in the bottle 10. To prevent possible contamination of the fluid, a cap 22 is secured on the bottle opening. To provide access to the fluid, the cap 22 has an opening for passing a tube 20 through to siphon fluid from the bottle 10. Although the cap 22 may be made from a number of suitable materials, including rubber or cork, rubber is preferred for ease of insertion into the bottle opening and for minimizing the possibility of contaminating the bottle 10 with cork particles, for example.

Figure 2:
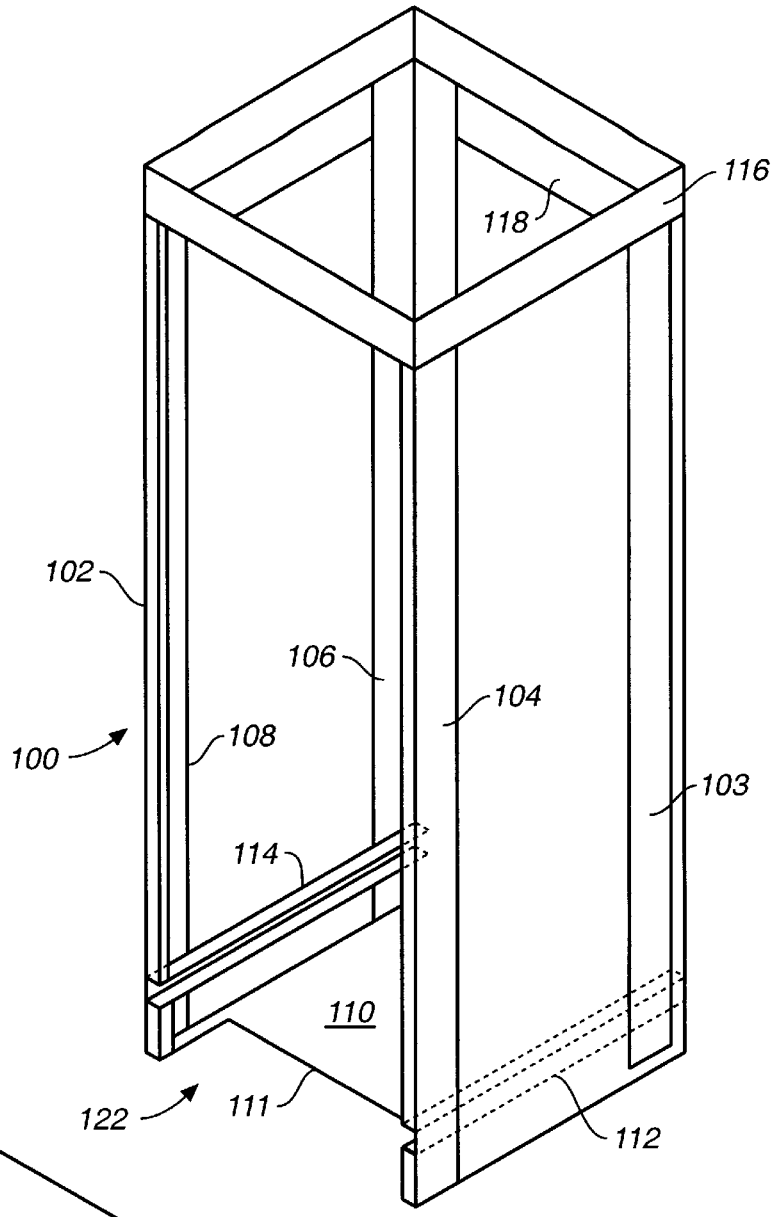
FIG. 2 is an isometric view of a cabinet for housing a bottle containing fluids as well as components associated with the fluid dispensing system.

Mounted above the water bottle 10 is a second chamber 130 for housing refrigeration, pump and control components, among other things. The second chamber 130 extends from a second base wall 116 surrounding a second chamber floor 118. The wall 116 and floor 118 support a standard refrigeration unit 141 such as a Model HMB1, available from Haws, Inc. of Berkeley, Calif. The second chamber floor 118 is mounted above a plurality of legs or stands 103 and 108 as well as legs or stands 104 and 106 (FIG. 2).

Further, the second chamber 130 houses an electrical control circuit 150 as well as a condenser 119. The condenser 119 and a series of refrigeration coils 131 cool a reservoir 140 which is located in the second chamber 130. A pump 132, when activated by the control circuit 150, removes fluid from the bottle 10 and transfers the fluid into the reservoir 140 when the fluid level falls below a predetermined threshold. The pump may be a low voltage pump which is available as a Model #1000, from Smart Pumps, Inc. of San Jose, Calif.

Mounted inside the reservoir 140 is a baffle 133. The baffle 133 improves the cooling capability of the reservoir 140 by expanding the available surface for dissipating thermal energy. Additionally, the baffle 133 minimizes possible turbulence inside the reservoir 140. Finally, the baffle 133 aids in settling of potential contaminants in the reservoir 140. Mounted above the baffle 133 is a support structure 134 for suspending a fluid level sensor 136. The sensor 136 detects whether the fluid inside the reservoir 140 has fallen below a minimum level and if so, actuates the control circuit 150 to turn on the pump 132 to transport fluid from the bottle 10 up to the reservoir 140. The sensor thus is a part of a refilling system for maintaining the reservoir fluid at a predetermined level. A second part of the refilling system is the pump 132 which transports fluid from the bottle 10 to the reservoir 140, and the control circuit 150 connected to the pump 132 and to the sensor 136 which activates the pump when fluid in the reservoir 140 falls below the predetermined fluid level.

Once the fluid has been transported into the reservoir 140, the refrigeration unit 141 can chill the fluid in the reservoir 140. Alternatively, in a second embodiment, the refrigeration unit 141 may be a heating unit for warming the fluid in the reservoir 140.

Further, a spigot 135 connected to the reservoir 140 allows the user to tap into the reservoir 140. When the bottle 10 is empty, the control circuit 150 disables the pump 132 to prevent pump burn-out caused by operating the pump 132 without any fluid in the reservoir 140.

During use, when an existing bottle becomes empty, the user first rolls-out the support base 122 with the empty bottle on it. The user then replaces the empty bottle with a full bottle to the slidable bottle support base 122 using a minimal amount of exertion since the bottle is close to the ground. Once the bottle 10 has been placed on the support base 122, the bottle support base may be pushed or rolled into the cabinet. The cap 22 with the tube 20 is placed onto the bottle's opening to connect the pump to the bottle. During operation, the control circuit energizes the pump when the fluid level in the reservoir falls below the predetermined fluid level. Moreover, the circuit detects when the bottle is empty and disables the pump to prevent damaging the pump.

Turning now to FIG. 2, the cabinet 100 is illustrated in more detail. In FIG. 2, the first chamber 102 has four support legs 103, 104, 106 and 108. At the bottom of the cabinet 100 is a bottom chassis 110. The bottom chassis 110 has a notch 111 which allows wheels 124 and 126 to move freely in and out of the cabinet 100. Additionally, rails 112 and 114 (shown in FIGS. 2 and 4) are mounted a predetermined distance above the bottom chassis 110. The rails 112 and 114 are adapted to engage and support the slidable bottle support base 122, as shown in detail in FIG. 3. The four legs 103, 104, 106 and 108 are joined at the top to a second chamber wall 116 which is connected to a second chamber chassis 118. The wall 116 and chassis 118 are adapted to receive the refrigeration unit 130.

Figure 3:
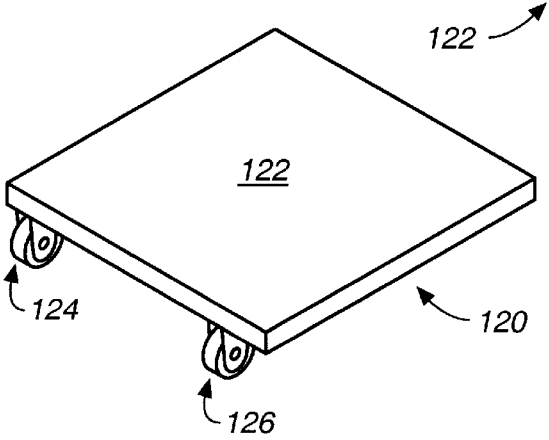
FIG. 3 is an isometric view showing a slidable bottle support base which is used in combination with the cabinet of FIG. 2.

Referring now to FIG. 3, the bottle support structure 120 is detailed. As shown in FIG. 3, the support base 122 has a plurality of castor wheels 124 and 126 mounted at the bottom of the support base 122. The bottom support structure 122 is placed on rails 112 and 114, and in conjunction with castor wheels 124 and 126, allows the user to easily move the bottle 10 in and out of the cabinet 100.

Figure 4:
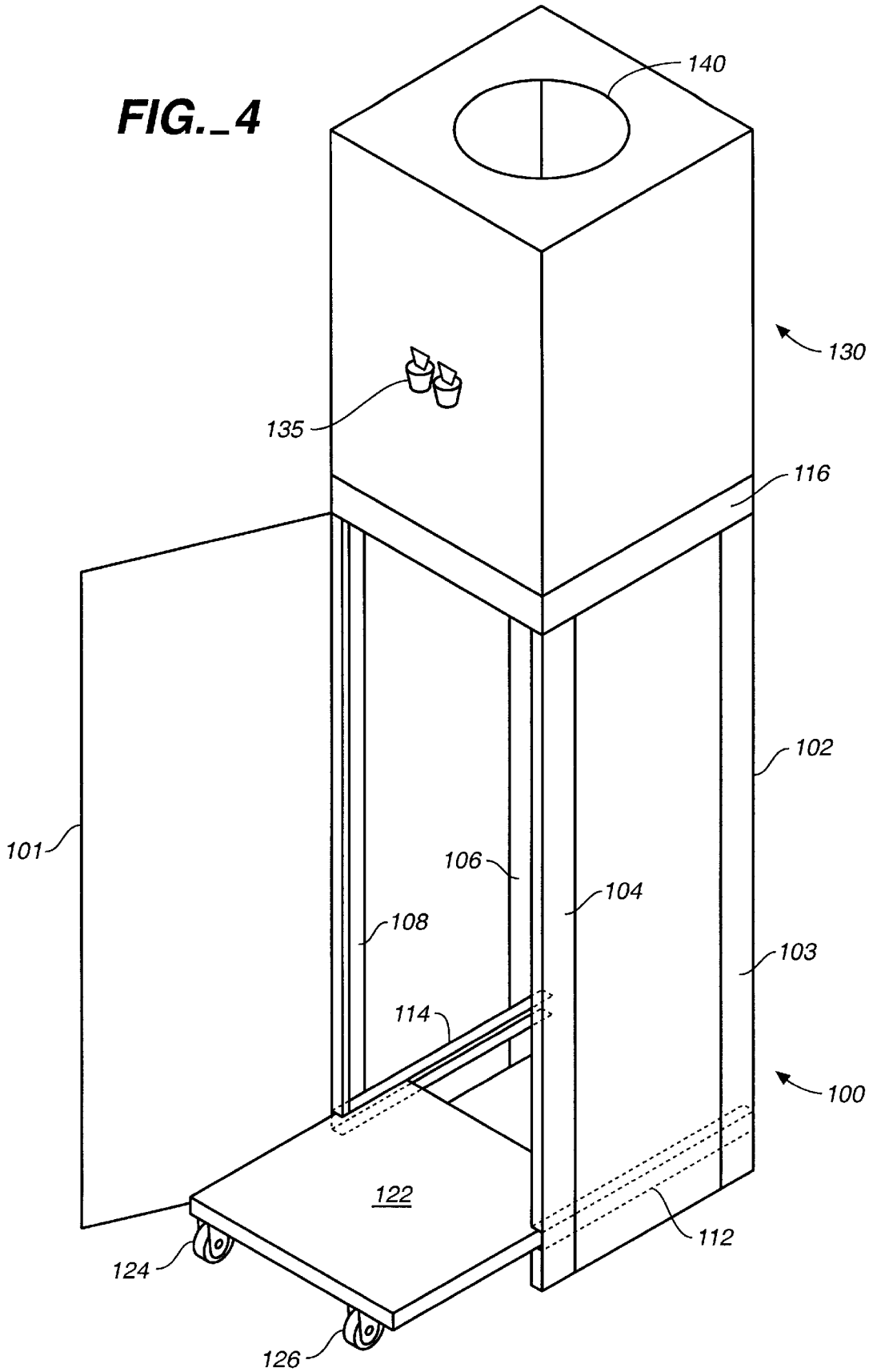
FIG. 4 is an isometric view of an assembled cabinet.

FIG. 4 illustrates an assembled fluid dispensing system. Additionally, FIG. 4 shows a door 101. The door 101 may be translucent to allow the user to peer into the first chamber 102 to determine whether the bottle 10 needs to be replaced. FIG. 4 shows that, when fluid is to be refilled, the slidable bottle support base 122 is rolled out of the cabinet 100 toward the user so that the empty bottle may be removed and a full bottle may be placed on top of the support base 122 using a minimal amount of exertion since the bottle is close to the ground. Once the bottle has been moved to the support base, the bottle support base may be rolled into the cabinet. The cap with the tube is placed onto the bottle's opening to connect the pump to the bottle.

Thus, the invention allows the user to check whether the bottle is empty by looking through the door 101 if it is translucent, or otherwise by opening the door 101 in front of the cabinet. When the bottle is nearly empty, the refilling process simply entails pulling out the drawer supporting the empty bottle, removing the pump tubing from the empty bottle, placing it inside a new full bottle, and pushing the drawer back in.

Figure 5:
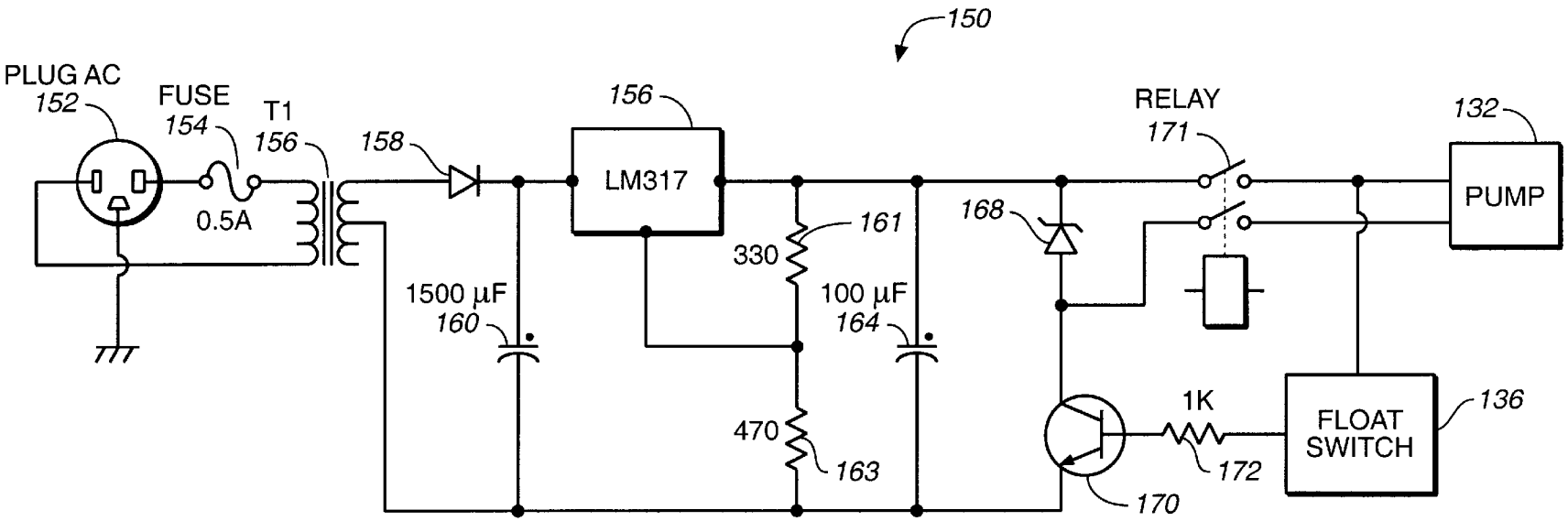
FIG. 5 illustrates a circuit for controlling components associated with the refilling and dispensing system of FIG. 1.

Turning now to FIG. 5, the control circuit 150 is shown in detail. The circuit of FIG. 5 is connected to an alternating current (AC) source 152. One end of the alternating current source is connected to a fuse 154, for example, a 0.5 ampere fuse. The fuse 154 is housed in an in-line fuse holder, and the output of the fuse 154 and one end of the AC source 152 are provided to a transformer 156. The transformer 156 is a step-down, low voltage transformer which converts the AC voltage to a predetermined low voltage such as 12 volts or 24 volts.

The output of the transformer 156 is connected to a diode 158. The output of the diode 158 in turn is provided to a capacitor 160. The combination of the diode 158 and the capacitor 160 provides a rectified and regulated DC low voltage. The voltage at the output of the diode 158 and the capacitor 160 is in turn provided to one input of a regulator 162, which may be a National Semiconductor LM317 regulator. One output of the regulator 162 is provided to a second capacitor 164 for filtering and smoothing the output voltage. The output is also connected to series resistors 161 and 163, whose junction is provided to a second input of the regulator 162.

The output of the float switch 136 in the reservoir 140 is connected to a resistor 172. The output of the resistor 172 in turn drives a transistor 170. The transistor 170 is connected to a diode 168, which in turn connects to the output of the regulator 162. When the fluid level exceeds the minimal fluid level, the switch 136 floats in a horizontal position and is in an off position. As such, the transistor 170 breaks the power connection supplying the output voltage of the second capacitor 164 to the pump 132. Alternatively, when the switch 136 is in a non-horizontal position, the transistor 170 turns on and allows electricity to be delivered to the pump 132. In this manner, water can be transported from the bottle 10 to the reservoir 140 whenever the water level falls below the predetermined threshold.

A timing relay 171 is positioned between the diode 168 and the pump 132. The relay 171 is used as a safety feature to prevent pump burn out. When the float switch 136 is in a non-horizontal position, the pump 132 turns on. The current flowing through the circuit triggers a built in timer in the timing relay 171. The timer in the timing relay 171 counts to a preset time and which allows the pump slightly more time than it would take to fill the reservoir from empty to full. If the bottle is empty or does not have enough water to fill the reservoir completely, then the timing relay 171 times out and shuts off the pump 132, thus protecting the pump from damage caused by operating the pump 132 when there is no water in the bottle.

Additionally, a second embodiment of the system may provide a second reservoir mounted in the second chamber with a second sensor for detecting a second predetermined fluid level. The second reservoir may have a second spigot to dispense the fluid upon request. This embodiment also has a second temperature adjustment system connected to the second reservoir to maintain the fluid at the second predetermined temperature range. Thus, the second embodiment supports the dispensing of fluids at differing temperatures.

Thus, as discussed above, the awkward lifting and inverting maneuver process in refilling conventional water coolers is avoided. Moreover, inexpensive, commonly available components can be used to construct the fluid dispensing device.

While one embodiment of the invention has been described in the above implementation, the invention is not limited thereto, but only by the spirit and scope of the following claims.

What is claimed is:

1. A system for storing and dispensing fluid, comprising:

a cabinet having first and second chambers;

a slidable support base mounted in the first chamber to support a container for storing fluid;

a reservoir mounted in the second chamber, said reservoir further having a spigot to dispense the fluid upon request;

a sensor for detecting a predetermined fluid level in the reservoir;

a temperature adjuster coupled to the reservoir to maintain the fluid at a predetermined temperature range;

a pump for transporting fluid from the container to the reservoir; and a circuit coupled to the pump and to the sensor for activating the pump when fluid in the reservoir falls below the predetermined fluid level, the circuit having a timing relay to prevent pump burn-out.

2. The system of claim 1, wherein the first chamber is proximal to the ground.

3. The system of claim 1, wherein the sensor is a float switch.

4. The system of claim 3, wherein the control circuit further comprises:

a voltage step-down converter for generating a predetermined voltage;

a switch coupled to the step-down converter, the pump, and the sensor, said switch supplying the predetermined voltage from the step-down converter to the pump when the sensor detects that the fluid in the reservoir is below the predetermined fluid level.

5. The system of claim 1, further comprising a timing relay coupled to the pump.

6. The system of claim 4, further comprising a voltage regulator coupled to the step-down converter.

7. The system of claim 6, wherein the voltage regulator generates a regulated direct current output.

8. The system of claim 1, further comprising a translucent door providing access to the first chamber.

9. The system of claim 1, further comprising a tube coupling the pump to the container.

10. The system of claim 9, further comprising a cap adapted to seal the container, the cap having an opening to receive the tube.

11. The system of claim 9, further comprising a second tube coupling the pump to the reservoir.

12. The system of claim 1, further comprising:

a second reservoir mounted in the second chamber, said second reservoir having a second sensor for detecting a second predetermined fluid level, said second reservoir further having a second spigot to dispense the fluid upon request;

a second temperature adjuster coupled to the second reservoir to maintain the fluid within a second predetermined temperature range.

13. The system of claim 1, wherein the slidable container support base is supported on one or more wheels.

14. The system of claim 1, wherein the predetermined temperature is lower than ambient temperature.

15. The system of claim 1, wherein the predetermined temperature is warmer than ambient temperature.

16. A method for dispensing a fluid, comprising:

transferring a container to a slidable container support base, the slidable container support base positioned adjacent to the ground;

sliding the container support base and the container into a cabinet;

connecting a pump to the container;

maintaining the fluid within the container at a predetermined temperature range;

detecting a fluid level in a reservoir in the cabinet; and pumping fluid from the container to the reservoir when fluid in the reservoir falls below a predetermined fluid level while protecting the pump against burn-out.

17. The method of claim 16, further including cooling the temperature of the fluid in the reservoir below ambient temperature.

18. The method of claim 16, further comprising warming the temperature of the fluid in the reservoir above ambient temperature.

19. The method of claim 16, further comprising storing fluid in a second container and dispensing fluid from the second container.

20. The method of claim 19, further comprising disabling the pump when the container is empty.

* * * * *